US007465265B2

(12) United States Patent
Hinesley

(10) Patent No.: US 7,465,265 B2
(45) Date of Patent: Dec. 16, 2008

(54) METHOD FOR INSTALLING CLOSURE IN MOUTH OF PRE-MADE BAG

(75) Inventor: Steven Edwin Hinesley, Franklin, TN (US)

(73) Assignee: Illinois Tool Works Inc., Glenview, IL (US)

( * ) Notice: Subject to any disclaimer, the term of this patent is extended or adjusted under 35 U.S.C. 154(b) by 473 days.

(21) Appl. No.: 11/189,196

(22) Filed: Jul. 25, 2005

(65) Prior Publication Data

US 2007/0021285 A1 Jan. 25, 2007

(51) Int. Cl.
*B31B 1/90* (2006.01)

(52) U.S. Cl. ..... 493/231; 493/195; 493/200; 493/210; 493/213; 493/215; 493/227; 493/267

(58) Field of Classification Search ..... 493/189, 493/193–195, 198, 199–200, 210, 212–215, 493/227, 231, 238, 243, 260, 264, 267
See application file for complete search history.

(56) References Cited

U.S. PATENT DOCUMENTS

| | | | | | |
|---|---|---|---|---|---|
| 4,453,370 | A * | 6/1984 | Titchenal | ..... | 53/455 |
| 4,524,459 | A * | 6/1985 | Titchenal | ..... | 383/37 |
| 5,121,997 | A | 6/1992 | La Pierre et al. | | |
| 5,211,482 | A | 5/1993 | Tilman | | |
| 5,275,491 | A * | 1/1994 | Kuge et al. | ..... | 383/61.2 |
| 5,456,928 | A | 10/1995 | Hustad et al. | | |
| 5,826,401 | A | 10/1998 | Bois | | |
| 6,360,513 | B1 * | 3/2002 | Strand et al. | ..... | 53/412 |
| 6,364,820 | B1 * | 4/2002 | Jostler et al. | ..... | 493/214 |
| 6,467,956 | B1 * | 10/2002 | Tilman et al. | ..... | 383/61.3 |
| 6,910,806 | B2 * | 6/2005 | Strand et al. | ..... | 383/61.2 |
| 2004/0058039 | A1 | 3/2004 | Strand et al. | | |

FOREIGN PATENT DOCUMENTS

| | | | |
|---|---|---|---|
| FR | 2686063 | A | 7/1993 |
| JP | 07100972 | A | 4/1995 |

* cited by examiner

*Primary Examiner*—Christopher Harmon
(74) *Attorney, Agent, or Firm*—Ostrager Chong Flaherty & Broitman P.C.

(57) ABSTRACT

A method for installing a closure in the mouth of a pre-made flexible bag. The closure may, for example, be a shrouded plastic zipper with or without a slider. The bag may, for example, have side gussets. In the disclosed embodiment, the bag is made using a laminated material comprising an interior layer of thermoplastic material and a non-interior layer of non-thermoplastic material, such as paper. The package is made by a method comprising the following steps: method for providing a bag with a closure, comprising the following steps: (a) slitting the bag along first and second lines so that a top marginal portion of one wall of the bag disposed between the first and second lines forms a flap; (b) folding back the flap to uncover a topmost portion of the other wall; (c) joining one side of a closure to at least a portion of the topmost portion of the other wall uncovered by step (b); and (d) joining a portion of the flap to the other side of the closure after steps (a)-(c) have been performed.

16 Claims, 7 Drawing Sheets

METHOD FOR INSTALLING CLOSURE IN MOUTH OF PRE-MADE BAG

BACKGROUND OF THE INVENTION

This invention generally relates to reclosable packaging. In particular, this invention relates to reclosable packaging having an external shroud or header that covers a plastic zipper or fastener.

Reclosable fastener assemblies are useful for sealing pouches or bags. Such fastener assemblies often include a plastic zipper and a slider. Typically, each zipper comprises a pair of interlockable fastener elements, or profiles. As the slider moves across the profiles, the profiles are opened or closed. The profiles in plastic zippers can take on various configurations, e.g. interlocking rib and groove elements having so-called male and female profiles, interlocking alternating hook-shaped closure members, etc.

Gusseted bags having thermoplastic zippers are well known in the reclosable packaging art. One advantage of such gusseted bags is that they may be opened more fully to facilitate filling the bag and later removing its contents. In some designs a gusseted side of the bag can be used to form a pouring spout by pulling the gusset outward and then inverting the bag, in which event the pourable contents of the package can be made to pour down the V-shaped channel formed by the gusset panels.

In the pet food industry, dry pet food is often packaged in a gusseted bag made of a laminated material. The outermost layer of the laminate is made of paper having a finish suitable for printing thereon. The innermost layer of the laminate is a sealant layer made of plastic material. This sealant layer allows the contents of the bag to be hermetically sealed to maintain freshness. An intermediate layer of the laminate is made of brown paper.

U.S. patent application Ser. No. 10/759,800, entitled "Easy-Open Shrouded Slider-Zipper Assembly for Reclosable Bag", discloses a shroud comprising a folded web having an inverted U-shaped profile that covers a slider-zipper assembly, the zipper of which is heat sealed to the shroud. In accordance with the disclosed method of manufacture, the free sides or legs of that shroud are inserted into the mouth of the receptacle. In that position, thermoplastic exterior surfaces of the sides of the shroud are heat sealed to thermoplastic interior surfaces of the receptacle. In the completed package, the shroud covers the zipper in a manner that provides evidence of tampering.

There is a need for alternative methods of making a reclosable package of the type disclosed in the preceding paragraph.

BRIEF DESCRIPTION OF THE INVENTION

The invention is directed to a method for installing a closure in the mouth of a pre-made flexible bag. The closure may, for example, be a shrouded plastic zipper with or without a slider. The bag may, for example, have side gussets. In the disclosed embodiment, the bag is made using a laminated material comprising an interior layer of thermoplastic material and at least one non-interior layer of non-thermoplastic material, such as paper.

One aspect of the invention is as a method for providing a gusseted bag with a closure, comprising the following steps: (a) slitting the gusseted bag along first and second lines so that a top marginal portion of one wall of the bag disposed between the first and second lines forms a flap; (b) arranging the top of the gusseted bag so that the topmost portions of the gussets on each side are not expanded and the flap does not cover the topmost portions of a respective gusset panel of a respective gusset or the topmost portion of the other wall disposed between the respective gusset panels; (c) joining one side of a closure to at least respective portions of the topmost portions of the respective gusset panels and the other wall exposed by step (b); and (d) joining a portion of the flap to the other side of the closure.

Another aspect of the invention is a method of attaching an easy-open shrouded slider-zipper assembly to a gusseted bag comprising first and second walls each having first and second side edges, a first side gusset comprising first and second gusset panels respectively connected or joined to the first side edges, and a second side gusset comprising third and fourth gusset panels respectively connected or joined to the second side edges, each of the first and second walls and the first through fourth gusset panels having interior surfaces comprising thermoplastic material and a non-interior layer of non-thermoplastic material, comprising the following steps: (a) making first and second slits that extend generally vertically from a top edge of the bag to at least a predetermined depth, the first slit being disposed along or near the first side edge of the first wall, and the second slit being disposed along or near the second side edge of the first wall, wherein a top marginal portion of the first wall that extends laterally from the first slit to the second slit forms a flap still connected to the remainder of the first wall; (b) moving the flap away from the second wall to expose a top portion of the interior surface of the first gusset panel of the first side gusset, a top portion of the interior surface of the third gusset panel of the second side gusset and a central section of a top portion of the interior surface of the second wall; (c) placing a shrouded slider-zipper assembly such that respective portions of a first side of a shroud respectively confront respective portions of the exposed portions of the interior surfaces; (d) joining respective portions of the first side of the shroud to respective confronting portions of the exposed portions of the interior surfaces to form a first zone of joinder that extends along the length of the shroud; (e) moving the flap to a position whereat a portion of an interior surface of the flap confronts a portion of a second side of the shroud; and (f) joining a portion of the interior surface of the flap to a confronting portion of the second side of the shroud along a second zone of joinder that extends along the length of the shroud.

A further aspect of the invention is a method for providing a bag with a closure, comprising the following steps: (a) slitting the bag along first and second lines so that a top marginal portion of one wall of the bag disposed between the first and second lines forms a flap; (b) folding back the flap to uncover a topmost portion of the other wall; (c) joining one side of a closure to at least a portions of the topmost portion of the other wall uncovered by step (b); and (d) joining a portion of the flap to the other side of the closure.

Other aspects of the invention are disclosed and claimed below.

BRIEF DESCRIPTION OF THE DRAWINGS

Reference will now be made to the drawings, in which similar elements in different drawings bear the same reference numerals.

DETAILED DESCRIPTION OF THE INVENTION

Figure 1:
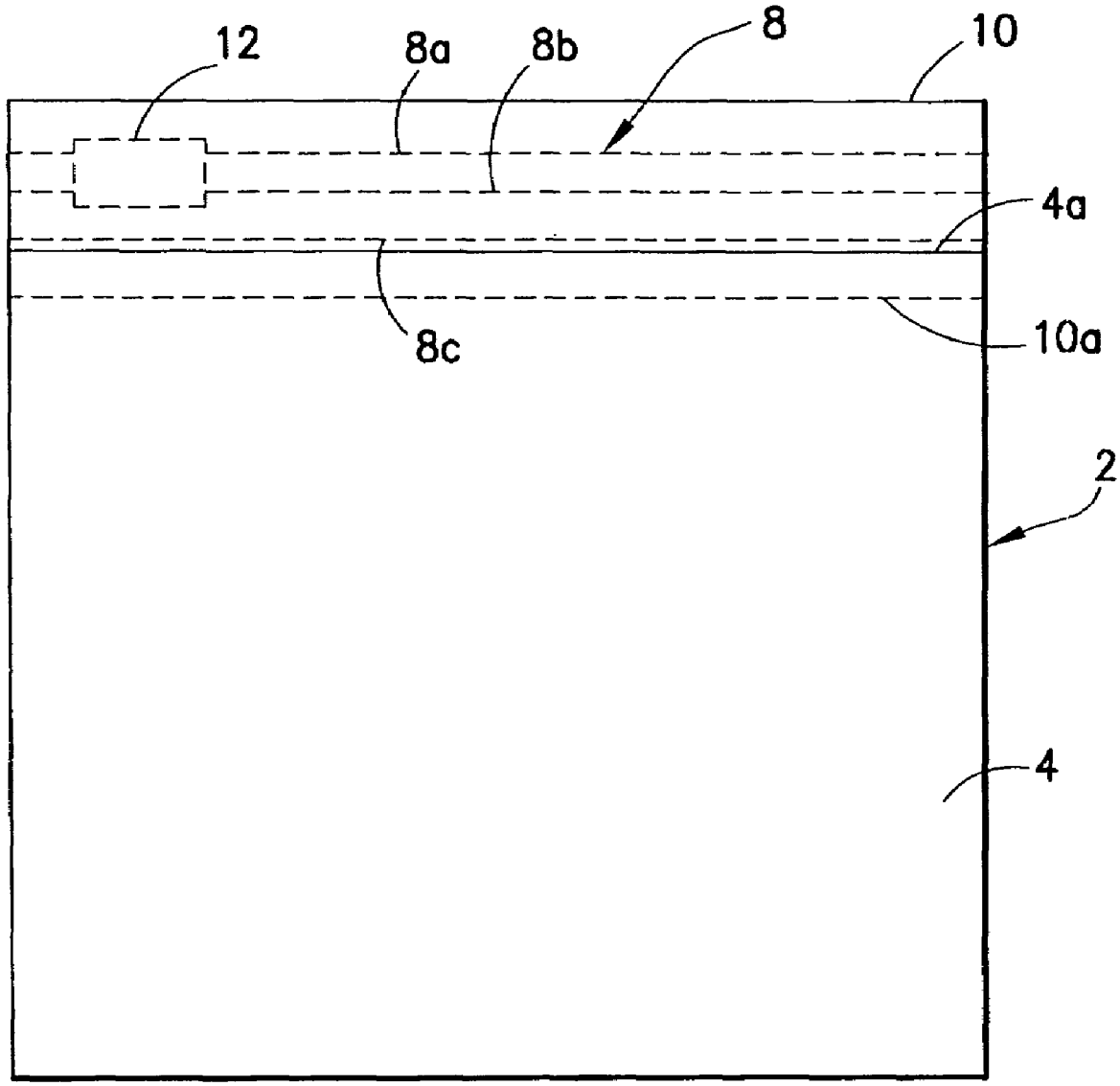
FIG. 1 PRIOR ART
FIG. 1 is a drawing showing a front view of a reclosable bag having a shrouded slider-zipper assembly as disclosed in U.S. patent application Ser. No. 10/759,800. The size of the assembly relative to the size of the bag has been exaggerated for illustrative purposes.

A reclosable bag as disclosed in U.S. patent application Ser. No. 10/759,800 is shown in FIG. 1. This known reclosable bag comprises a receptacle 2 formed by front and rear walls interconnected by a bottom wall and respective expanding gusseted side walls. Only the front wall 4 is visible in the view shown in FIG. 1. The receptacle 2 may, for example, be made of a laminated material comprising an inner sealant layer made of thermoplastic material, an outer layer made of paper having an outer surface suitable for printing, and an intermediate layer made of brown paper. Such a construction can be used to make reclosable bags for pet food, for example.

Reference numeral 4*a* in FIG. 1 designates the top edge of front wall 4 of the receptacle 2. The structure 10, which extends above the top of the receptacle 2, is a shroud comprising a folded web that has an inverted U-shaped profile. The free sides or legs of the folded web extend into the mouth of the receptacle, the bottom edge of the front side of the shroud 10 being indicated by dashed line 10*a*. The exterior surfaces of the sides of shroud 10 are heat sealed to interior surfaces of the receptacle 2. The interior surface of the inverted U-shaped shroud 10 forms the boundary of a shrouded space in which a slider-zipper assembly is disposed, as best seen in FIG. 2.

The slider-zipper assembly comprises an extruded plastic zipper 8 and a molded plastic slider 12 mounted thereto. In FIG. 1, the zipper is represented by the three horizontal dashed lines above the solid line 4*a*. The region bounded by dashed lines 8*a* and 8*b* represents a profiled closure member, while the region bounded by dashed lines 8*b* and 8*c* represents a flange or fin having one end connected to the profiled closure member.

Figure 2:
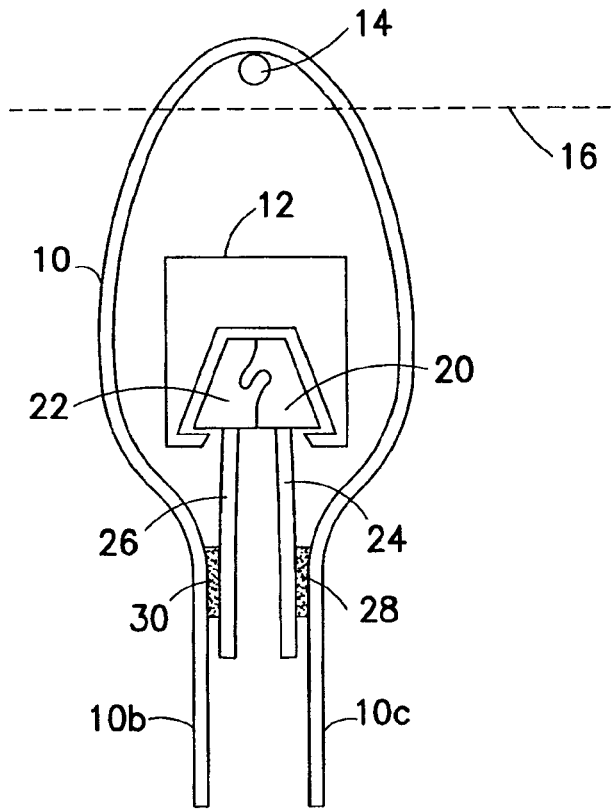
FIG.2 PRIOR ART
FIG. 2 is a drawing showing a sectional view of a shrouded slider-zipper assembly incorporated in the reclosable bag seen in FIG. 1.

Referring to FIG. 2, the zipper 8 comprises first and second flanged zipper parts. The first flanged zipper part comprises a first profiled closure member 22 and a first flange 26, and the second flanged zipper part comprises a second profiled closure member 20 and a second flange 24. The profiled closure members 20 and 22 are mutually interlockable. Flange 24 has a portion joined to an opposing portion on one side 10*c* of the shroud 10, while the flange 26 has a portion joined to an opposing portion on the other side 10*b* of the shroud 10. In other words, the zipper flanges are joined (i.e., heat sealed to form so-called "permanent" seals) to the interior of the shroud 10 on opposing sides of the shrouded space.

The slider 12 is mounted to the zipper and is configured to close portions of the zipper as the slider is moved in one direction along the zipper and to open portions of the zipper as the slider is moved in the opposite direction along the zipper in the manner disclosed in detail in U.S. Pat. No. 6,047,450.

Still referring to FIG. 2, the shroud 10 is provided with a pair of lines of weakened tear resistance (hereinafter "tear lines") at the two locations intersected by dashed line 16. However, two tear lines are not necessary, as one tear line would be sufficient to tear open the shroud. To facilitating tearing open, the shroud 10 is further provided with a plastic tear bead 14, which is typically gripped between the forefinger and the thumb by the consumer. This allows the cap of the shroud (i.e., the portion of the shroud above the dashed line 16) to be torn off, thereby allowing the consumer to have access to the slider-zipper assembly. The consumer can then gain access to the contents of the reclosable bag by moving the slider along the zipper in the opening direction, which causes the interlocked zipper parts to disengage. Alternatively, the tear lines may be disposed at an elevation below the zipper profiles so that the slider will be fully exposed and accessible to the consumer.

Figure 3:
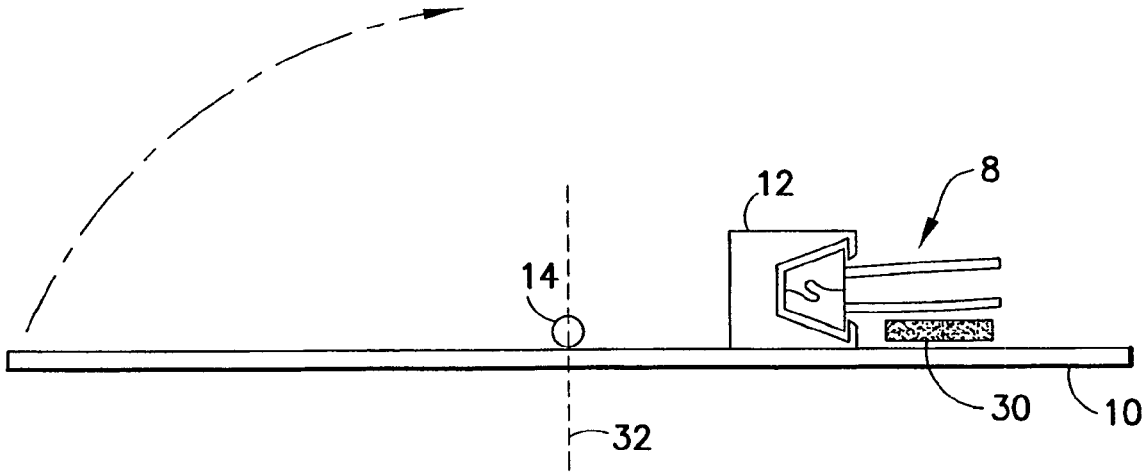
FIG.3 PRIOR ART
FIG. 3 is a drawing showing several steps of one method of manufacturing the shrouded slider-zipper assembly shown in FIG. 2.

FIG. 3 illustrates various steps of one method for making the shrouded slider-zipper assembly. A continuous strip of film 10 is laid flat, A slider-zipper assembly (comprising a multiplicity of sliders mounted to a continuous zipper at spaced intervals therealong) is laid on its side on top of the strip 10 in a lengthwise direction. Also a pull bead 14 is laid on top of strip 10 near (as seen in FIG. 3) or at and parallel to the centerline of the strip 10, which centerline is indicated by dashed line 32. The lower zipper flange is heat sealed to the strip 10 to form a permanent seal 30. Likewise the pull bead 14 is heat sealed to the strip 10. The strip 10 is then folded in half (indicated by the curved dash-dot arrow in FIG. 3) so that the folded-over portion of the strip overlies the slider-zipper assembly and the other half of the strip (not shown in FIG. 3). The folded-over portion of strip 10 is then heat sealed to the upper zipper flange to form a permanent seal (not shown in FIG. 3, but see item 28 in FIG. 2). In the folded-over and sealed configuration, the strip 10 becomes the previously described shroud 10.

Alternatively, instead of sealing one zipper flange, folding the web over, and then sealing the other zipper flange, first the web 10 is folded and then the slider-zipper assembly can be inserted between the sides of the folded shroud and sealed in place, the two zipper flanges being heat sealed concurrently by a pair of opposing heated sealing bars. The amount of heat applied in this operation can be controlled to prevent seal-through of the zipper flanges. Alternatively, seal-through can be prevented by placing a separator plate between the zipper flanges during the sealing operation.

Figure 4:
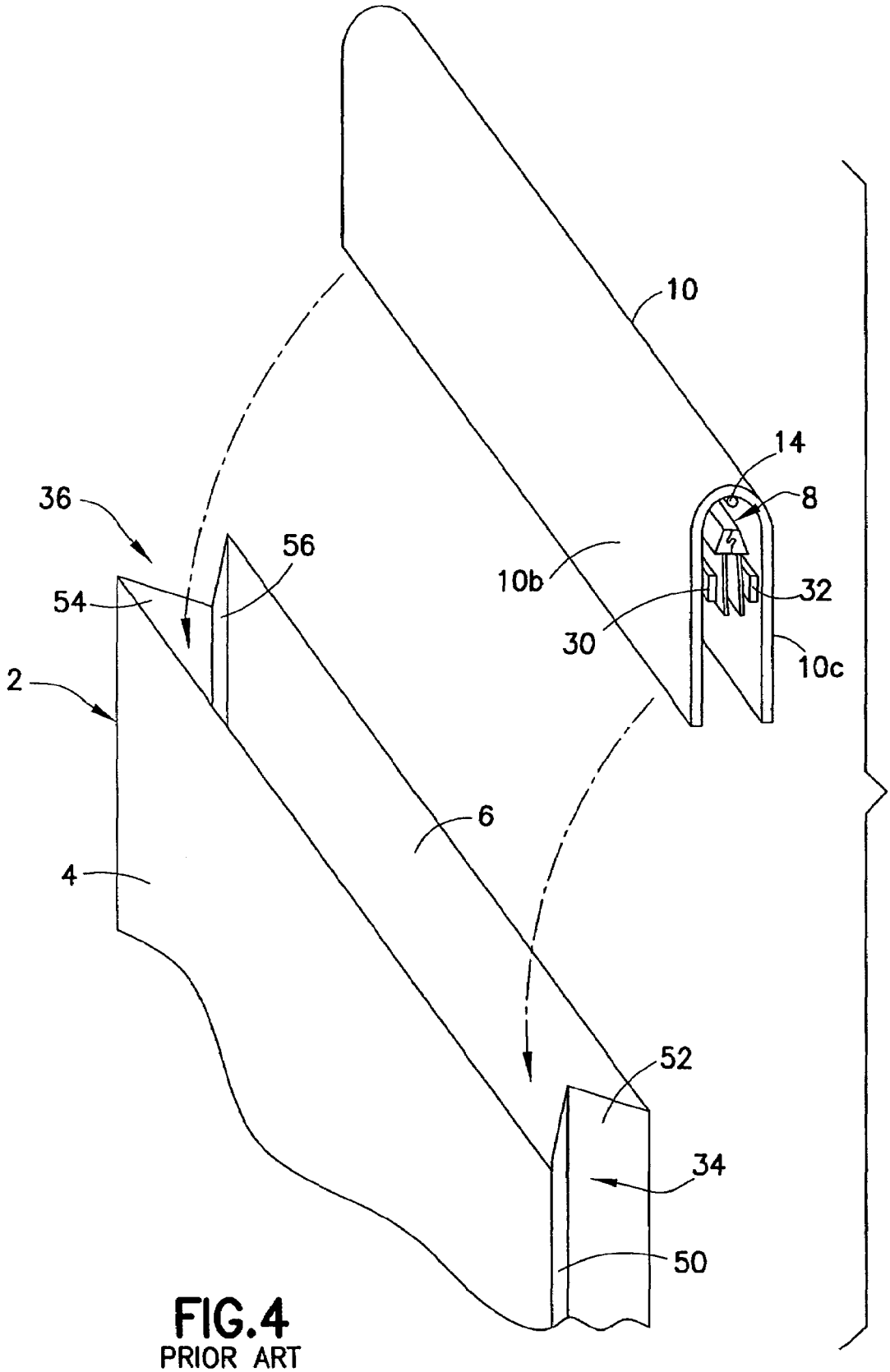
FIG.4 PRIOR ART
FIG. 4 is a drawing showing an isometric view of a shrouded slider-zipper assembly being inserted into the mouth of a pre-made bag in accordance with one method of manufacture disclosed in U.S. patent application Ser. No. 10/759,800.

One known method for installing the assembly shown in FIG. 2 in the mouth of a pre-made bag comprises the step, depicted in FIG. 4, of inserting an individual shrouded slider-zipper assembly as a unit into the mouth of a pre-made bag or receptacle 2. In this example, the receptacle 2 comprises a front wall 4, a rear wall 6, a first side gusset 34 interconnecting the front and rear walls on one side of the bag, and a second side gusset 36 interconnecting the front and rear walls on the other side of the bag. Each side gusset comprises a respective pair of gusset panels that allow the sides of the bag to expand and contract at the gussets. In FIG. 4, the sides of the shroud 10 have been designated 10*b* and 10*c* and comprise opposing portions of the folded web that are connected by the fold.

The sides 10*b* and 10*c* of the shroud 10 are inserted adjacent receptacle wall 4, with the ends of the sides 10*b* and 10*c* intervening between wall 4 and the opposing gusset side panels. Thereafter, the shroud is sealed in place by application of heat and pressure, which causes the thermoplastic material of the shroud to seal to or fuse with the inner thermoplastic sealant layer of the laminated receptacle 2 (the respective layers of the lamination are not shown in FIG. 4), with the paper layers as previously described being unaffected.

As shown in FIG. 4, side gusset 34 comprises a panel 50 connected to the front wall 4, and a panel 52 connected to the panel 50 and to the rear wall 6. Similarly, side gusset 36 comprises a panel 54 connected to the front wall 4, and a panel 56 connected to the panel 54 and to the rear wall 6. During the sealing operation, a central portion of the rear wall 6 at the elevation of the shroud is pressed against the side 10*c* of the shroud 10, while end portions of the rear wall 6 are pressed against the respective gusset panels 52 and 56, causing a central portion of side 10*c* of the shroud 10 and respective portions of the sealant layer on the interior surfaces of the gusset panels 52 and 56 to seal to the sealant layer on the interior surface of the rear wall 6. At the same time, the side 10*b* of the shroud 10 is sealed to the sealant layer on the interior surface of the front wall 4, while respective portions of the sealant layer on the interior surfaces of the gusset panels 50 and 54 are sealed to end portions of side 10*c* of the shroud 10.

During the aforementioned sealing operation, a pair of opposing heated sealing bars are placed on opposite sides of the bag mouth with the shrouded slider-zipper inserted in the bag mouth as shown in FIG. 4. In order to heat seal the thermoplastic interior surface layer of the gusset panel 50 to side 10*c* of the shroud 10, heat from the sealing bar at the rear wall 6 must pass through the rear wall 6 and the gusset panels 50 and 52, each of which is made of the same laminated material consisting of a layer of thermoplastic material and two layers of paper. Consequently, heat from the sealing bar at the rear wall 6 must pass through six layers of paper, which has poor heat conductivity, making it difficult to heat seal the gusset panel 50 to the side 10*c* of shroud 10. The same is true for heat sealing the gusset panel 54 to the side 10*c* of shroud 10.

The instant invention is a method of manufacture that avoids heat sealing through multiple plies of the laminated bag material. This is achieved by slitting the front wall of the bag to create a flap, folding the flap to expose the thermoplastic interior surface layers of the topmost portions of the adjoining gusset panels and of the major portion of the rear wall not overlapped by the gusset panels, and then heat sealing the rear side of the shroud to those exposed thermoplastic surfaces. Thereafter, the flap is returned to its original position, where it is heat sealed to the front side of the shroud. In the first sealing operation, the heat from a heated sealing bar is conducted through one side of the shroud, which is made of thermoplastic material (and no paper). In the second sealing operation, the heat from a heated sealing bar is conducted through the front wall of the bag, which is a laminate having one layer of thermoplastic material and two layers of paper (i.e., one ply of the laminated bag material). The steps in accordance with one method of manufacture will now be described in detail with reference to FIGS. 5-10.

Figure 5:
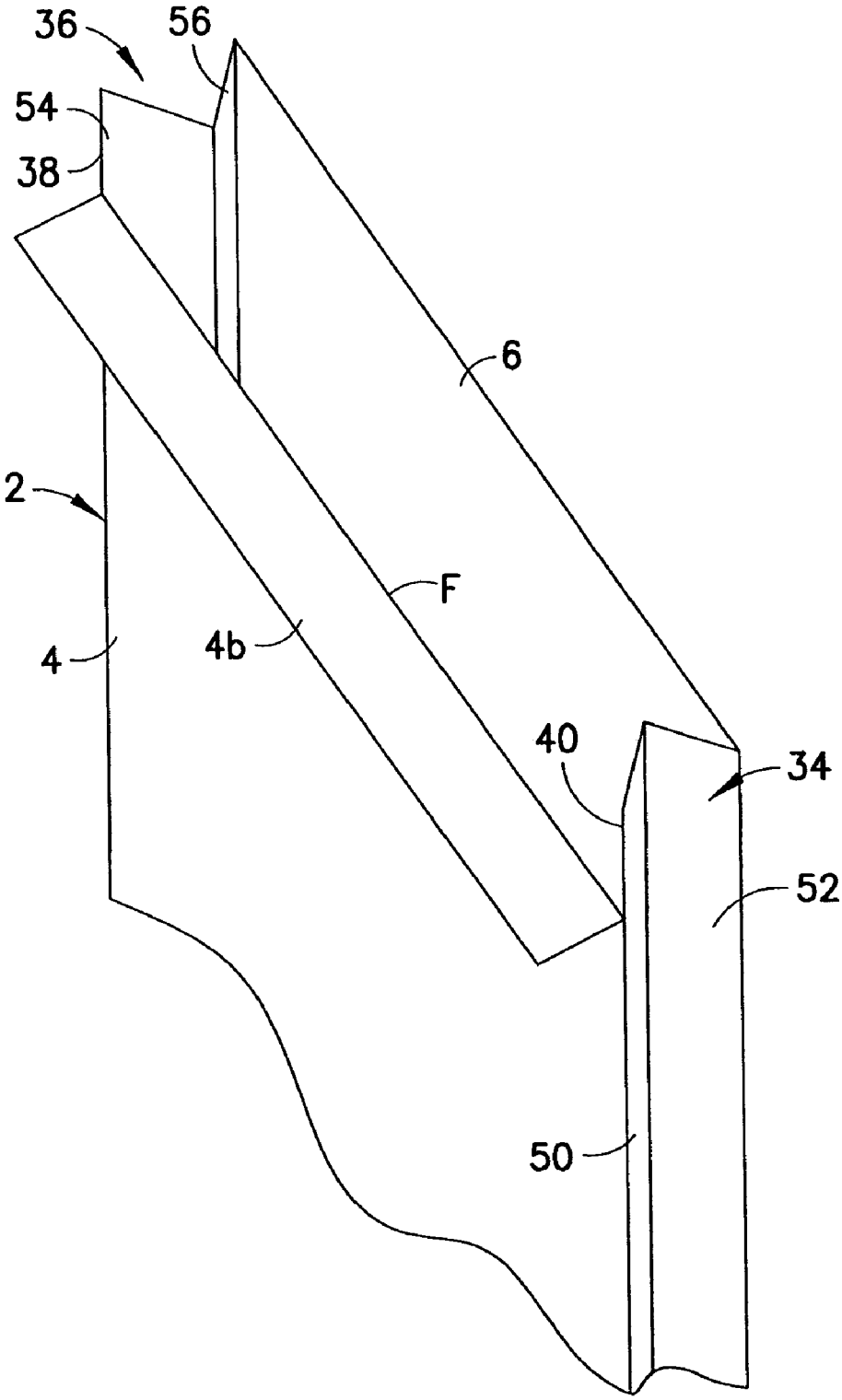
FIG. 5 is a drawing showing an isometric view of a pre-made bag after two slits have been made and after the flap formed by those slits has been pivoted to expose the opposing portions of the bag in accordance with one method of manufacture.
Figure 6:
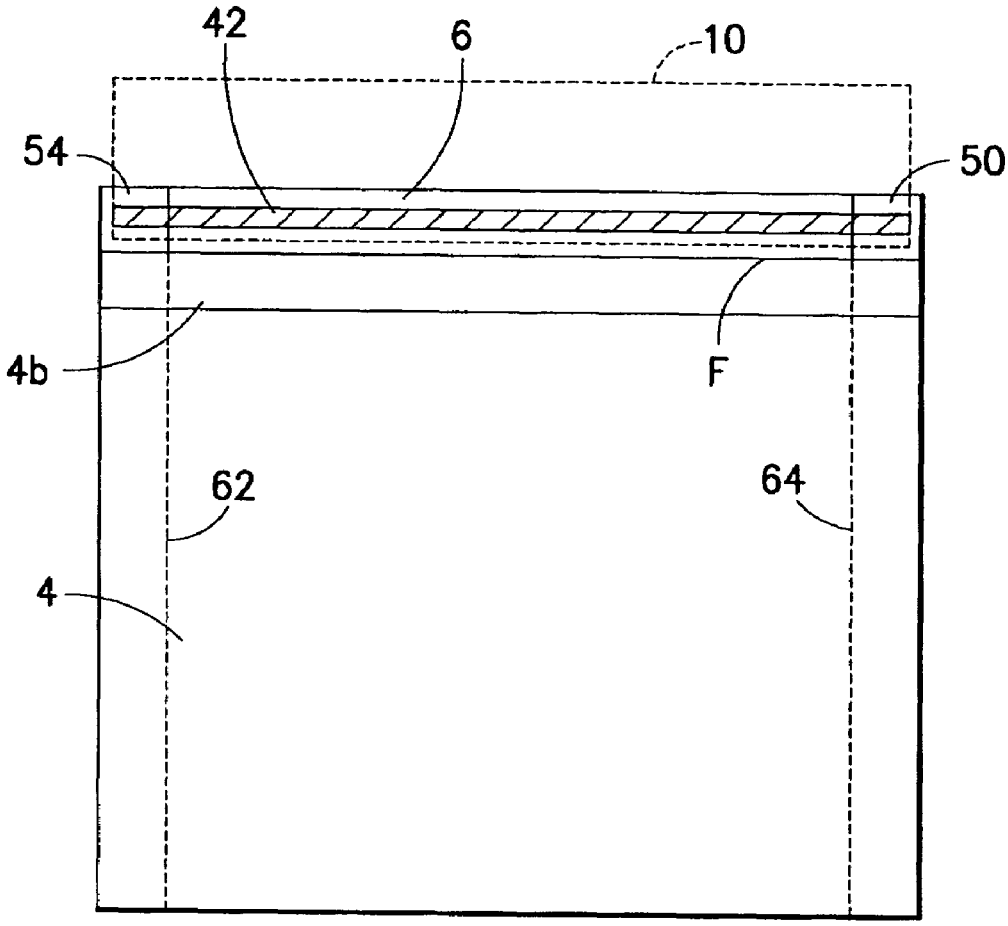
FIG. 6 is a front view of a pre-made gusseted bag with a folded flap at the top for exposing thermoplastic interior surfaces to which a shrouded slider-zipper assembly can be joined in accordance with the disclosed method of manufacture. The zone of joinder is indicated by hatching.
Figure 10:
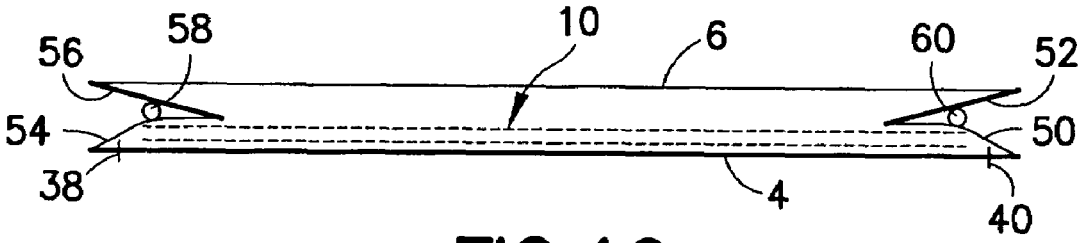
FIG. 10 is a schematic showing the respective positions of the walls of the shroud (indicated by a pair of parallel dashed lines) when installed into the mouth of the pre-made gusseted bag in accordance with the disclosed method of manufacture.

In accordance with the method of manufacture disclosed herein, a pre-made bag comprising front and rear walls 4 and 6 and side gussets 34 and 36 is slit in two places, as seen in FIG. 5. In this example, the topmost portion of the bag is slit along vertical lines 38 and 40 which each extend from the top edge of the bag for a predetermined distance. In the example shown in FIG. 5, slit 38 is made along the fold that connects the front wall 4 to the gusset panel 54 of side gusset 36, while slit 40 is made along the fold that connects the front wall 4 to the gusset panel 50 of side gusset 34. Alternatively, the slits could be made in the front wall a short distance from the respective aforementioned fold lines (as illustrated in FIG. 10). The slits are of equal length and form a flap 4*b* therebetween, which may be folded back as illustrated in FIG. 5 to expose the thermoplastic interior surface layers of the topmost portions of the gusset panels 50 and 54 and the topmost portion of a section of the rear wall 6 disposed between the topmost portions of the gusset panels 50 and 54 when the topmost portions of the gussets 34 and 36 are not expanded, i.e., when the topmost portions of the gusset panels 50 and 54 and the rear wall 6 are generally coplanar (e.g., when being pressed between mutually opposing sealing bars). The fold in the front wall 4 is designated F in FIG. 5. In the case of a 50-lb bag of pet food, the slits may be about 4 inches long. A stationary guide may be employed to deflect the flap from a vertical orientation to a horizontal orientation as the pre-made bag is advanced to the first sealing station.

At the first sealing station, a pre-cut strip of a shrouded slider-zipper assembly is placed parallel to the top edge of the bag, with a portion of the shroud 10 (indicated by a dashed rectangle in FIG. 6) being disposed in front of the exposed thermoplastic interior surface layers of the gusset panels 50 and 54 and the rear wall 6. The aforementioned exposed portions of gusset panels 50 and 54 and rear wall 6 lie above the fold line F seen in FIG. 6. The rear side 10*c* of the shroud 10 is joined along its entire length to the exposed thermoplastic interior surface layers, as indicated by the band-shaped hatched zone 42 seen in FIG. 6. In a leftmost portion of the zone of joinder 42, the rear side 10*c* of shroud 10 is joined to the exposed thermoplastic interior surface layer of the gusset panel 54; in a rightmost portion of the zone of joinder 42, the rear side 10*c* of shroud 10 is joined to the exposed thermoplastic interior surface layer of the gusset panel 50; and in a central portion of the zone of joinder 42, the rear side 10*c* of shroud 10 is joined to the exposed thermoplastic interior surface layer of a section of the rear wall 6 that is disposed between the cusps of the side gussets. [As used herein, the term "cusp of a side gusset" refers to the fold line where the gusset panels of that side gusset are connected to each other.] The portions of the side gusset cusps disposed below the fold line F of the front wall 4 are indicated by vertical dashed lines in FIG. 6.

Figure 7:
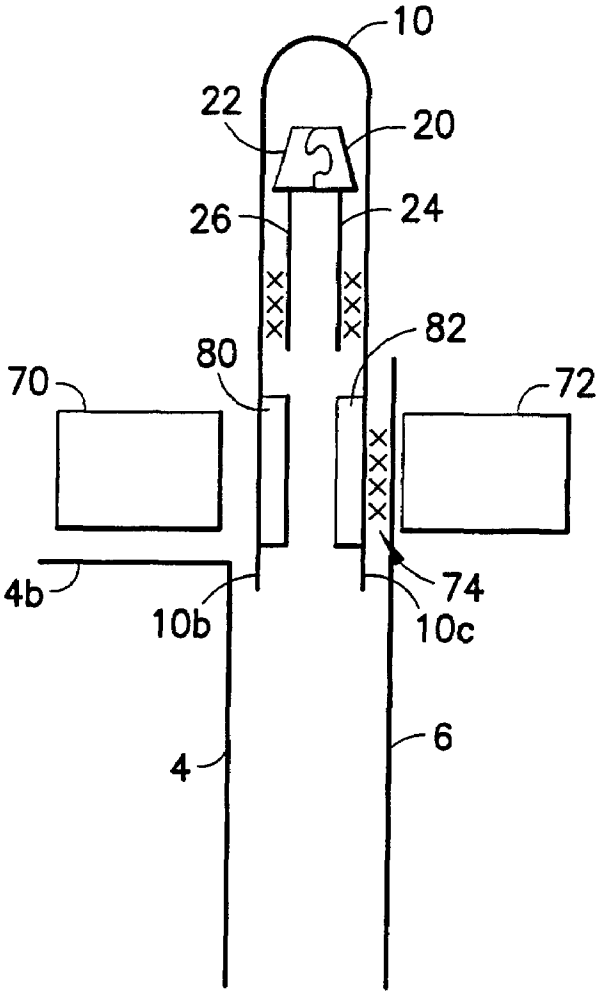
FIG. 7 is a schematic illustrating a first heat sealing operation in accordance with the disclosed method of manufacture.

As best seen in FIG. 7, a central section of the lowermost portions of the sides 10*b* and 10*c* of shroud 10 overlap the exposed thermoplastic interior surface layer of a central portion of the rear wall 6. Not shown in FIG. 7 are the end sections of the lowermost portions of the sides 10*b* and 10*c* of shroud 10, which respectively overlap the exposed thermoplastic interior surface layers of respective portions of the gusset panels that are connected to the front wall 4. During heat sealing at the first sealing station, these overlapping portions are pressed together by a first pair of sealing bars 70 and 72. The sealing bar 70 is heated; the sealing bar 72 is not heated. Heat is applied at side 10*b* of shroud 10 by sealing bar 70, which heat is conducted through the sides 10*b* and 10*c* made of thermoplastic material. The temperature of the heated sealing bar 70, the pressure exerted by the sealing bars 70 and 72 and the length of time that pressure is exerted and heat is applied are selected so that the thermoplastic interior surface layer of the exposed portion of the rear wall 6 or the surface of the rear side 10*c* of shroud 10 or both soften or melt. When the sealing bars 70 and 72 are retracted, the softened or melted material cools, causing the rear wall 6 and the rear side 10*c* of shroud 10 to fuse together, forming a permanent heat seal 74 (indicated by a series of X's in FIG. 7). To prevent seal-through of the sides 10*b* and 10*c* of the shroud during this heat sealing operation, the interior surfaces of the sides 10*b* and 10*c* are coated with respective layers 80 and 82 of non-sealant material (e.g., HDPE) in the band-shaped zones that lie between the sealing bars 70 and 72. The non-sealant material has a melting temperature that is higher than the melting temperature of the shroud material.

Figure 8:
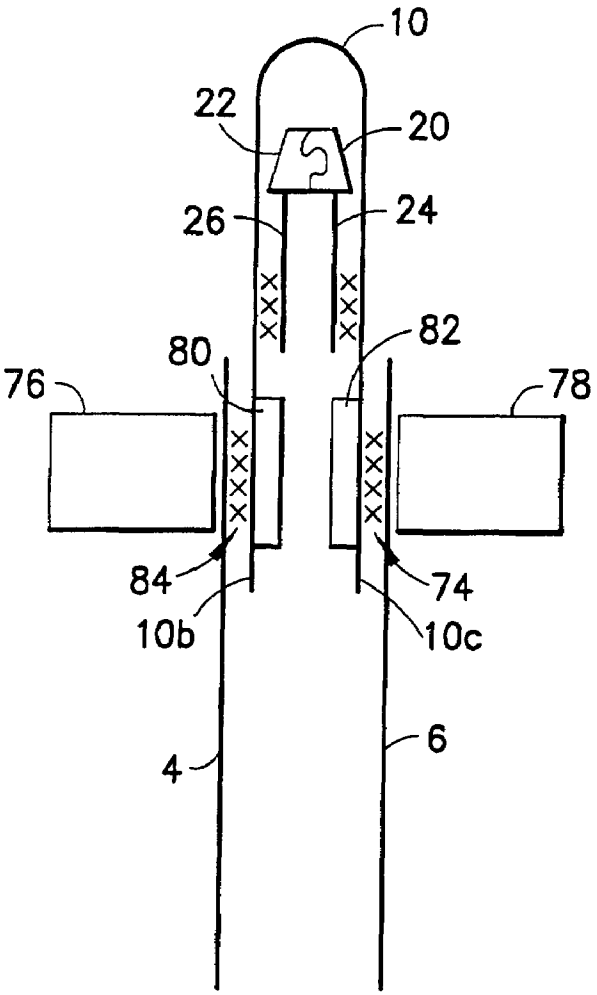
FIG. 8 is a schematic illustrating a second heat sealing operation in accordance with the disclosed method of manufacture.

As the pre-made bag with attached shrouded slider-zipper assembly is advanced to the second sealing station, another stationary guide deflects the flap 4*b* back to its original vertical position, so that the flap now overlaps the lowermost portions of the sides 10*b* and 10*c* of shroud 10, as seen in FIG. 8. During heat sealing at the second sealing station, these overlapping portions are pressed together by a second pair of sealing bars 76 and 78. The sealing bar 76 is heated; the sealing bar 78 is not heated. Heat is applied at the exterior surface (made of paper) of flap 4*b*. The temperature of the heated sealing bar 76, the pressure exerted by the sealing bars 76 and 78 and the length of time that pressure is exerted and heat is applied are selected so that the thermoplastic interior surface layer of the flap 4*b* or the surface of the front side 10*b* of shroud 10 or both soften or melt. When the sealing bars 76 and 78 are retracted, the softened or melted material cools, causing the flap 4*b* and the front side 10*b* of shroud 10 to fuse together, forming a permanent heat seal 84 (indicated by a series of X's in FIG. 8).

Figure 9:
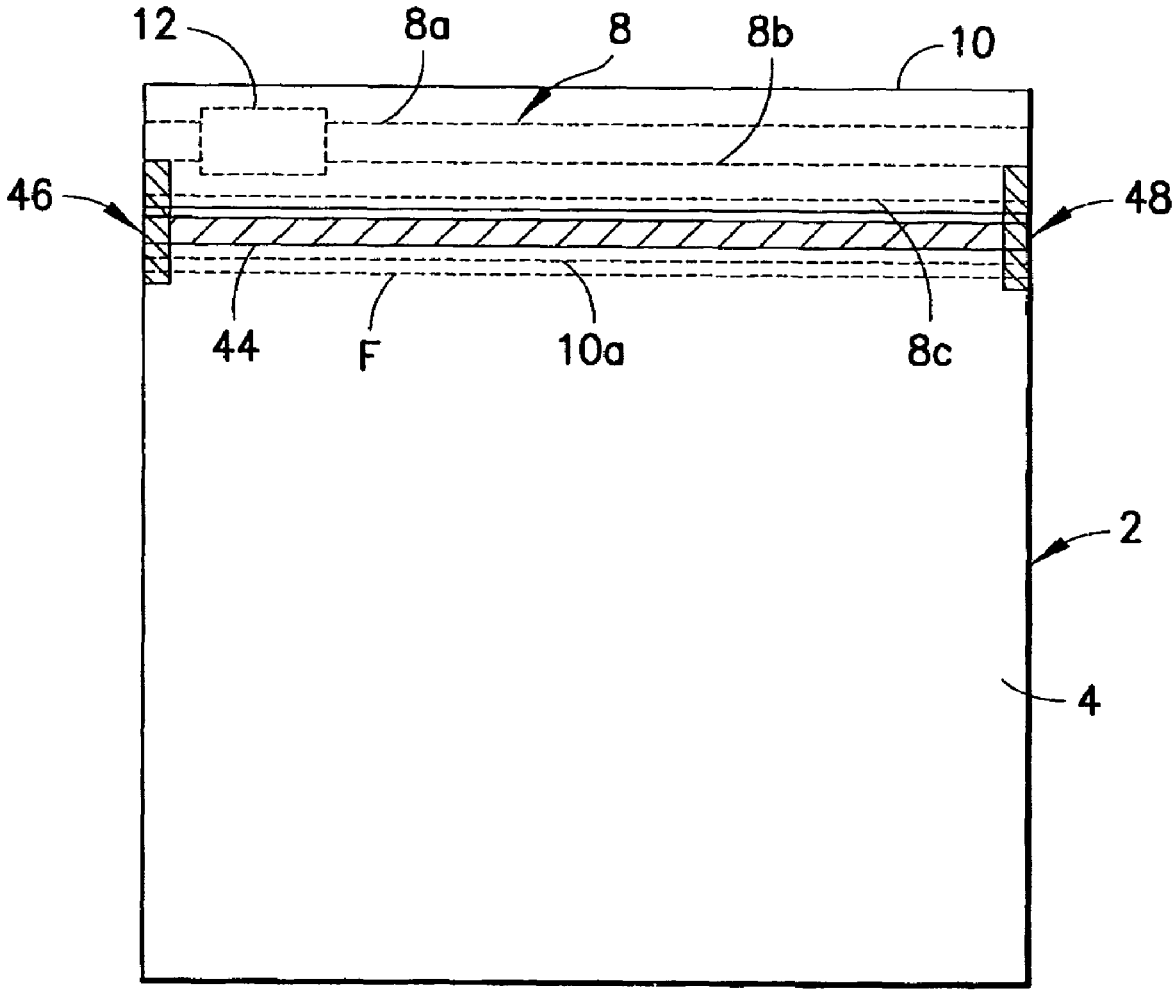
FIG. 9 is a front view of a pre-made bag after the shrouded slider-zipper assembly has been joined to the receptacle and after the slits have been sealed in accordance with the disclosed method of manufacture.

In the next stage of manufacture depicted in FIG. 9, the slits are closed by heat sealing the bag in areas 46 and 48, which extend along the full length of the slits that were formed. In the case where the slits were made along the fold lines that connected the front wall to respective gusset panels, the heat sealing in areas 46 and 48 will join respective portions of the front wall that are adjacent to the slit to respective underlying portions of the gusset panels that are also adjacent to and on the other side of the slit, thereby closing the slits. In the case where the slits were made in the front wall a short distance from the fold lines that connected the front wall to respective gusset panels, the heat sealing in areas 46 and 48 will join respective portions of the front wall on both sides of each slit to respective underlying portions of the gusset panels.

The reclosable bag disclosed herein may be subjected to substantial stresses during distribution and in use. In the event that the heat-sealed areas where the slits have been closed require reinforcement, this can be accomplished by tacking the gusset panels together behind the heat-sealed areas 46 and 48. FIG. 10 depicts an embodiment wherein gusset panels 50 and 52 have been tacked together by a spot of glue 60, and gusset panels 54 and 56 have been tacked together by a spot of glue 58. The parallel dashed lines in FIG. 10 represent the sides of the shroud.

The present invention is not limited to the particular slider and zipper structures depicted in FIG. 2. In the case of the particular slider-zipper assembly shown in FIG. 2, the slider 12 does not have a separating finger or plow. However, slider-zipper assemblies wherein the slider has a separating finger can be employed. With regard to the zipper, one zipper part may have a male closure profile and the other zipper part may have a female closure profile designed to receive and interlock with the male profile. Alternatively, the zipper may comprise alternating hook-shaped closure elements that interleave when the zipper halves are brought together.

While the invention has been described with reference to various embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the verb "joined" means fused, bonded, sealed, or adhered, whether by application of heat and/or pressure, application of ultrasonic energy, application of a layer of adhesive material or bonding agent, interposition of an adhesive or bonding strip, etc. Also, in the absence of explicit language in any method claim setting forth the order in which certain steps should be performed, the method claims should not be construed to require that steps be performed in the order in which they are recited.

The invention claimed is:

1. A method for providing a gusseted bag made of a laminated material with a closure comprising a folded web of thermoplastic material, said laminated material comprising an interior layer of thermoplastic material and a non-interior layer of non-thermoplastic material, said method comprising the following steps:

(a) slitting the gusseted bag along first and second lines so that a top marginal portion of one wall of the bag disposed between said first and second lines forms a flap;

(b) arranging the top of the gusseted bag so that the topmost portions of the gussets on each side are not expanded and the flap does not cover the topmost portions of a respective gusset panel of a respective gusset or the topmost portion of the other wall disposed between said respective gusset panels;

(c) joining one leg of said folded web of thermoplastic material to said inner layer of thermoplastic material of at least respective portions of the topmost portions of said respective gusset panels and said other wall exposed by step (b); and (d) joining said inner layer of thermoplastic material of a portion of said flap to the other leg of said web of thermoplastic material after steps (a)-(c) have been performed.

2. The method as recited in claim 1, wherein said joining steps are performed by melting or softening respective surfaces made of thermoplastic material.

3. The method as recited in claim 1, further comprising the step of sealing at least portions of the slits formed in step (a).

4. The method as recited in claim 1, wherein said closure further comprises a zipper joined to and covered by said folded web.

5. The method as recited in claim 4, further comprising the step of joining the opposite ends of said first leg of said folded web to the respective opposite ends of said second leg of said folded web from distal edges of said first and second legs of said folded web up to said zipper.

6. The method as recited in claim 1, further comprising the steps of gluing the respective gusset panels of each gusset together near each end of the closure.

7. The method as recited in claim 1, wherein as a result of steps (c) and (d), respective zones of joinder are produced that extend along the entire length of said closure.

8. The method as recited in claim 1, further comprising the steps of joining a portion of the topmost portion of said other wall that is not joined to said folded web to a topmost portion of a gusset panel that is not joined to said folded web.

9. The method as recited in claim 1, wherein heat is conducted through both legs of said folded web and not through said flap during step (c).

10. The method as recited in claim 9, wherein the source of said heat is not in contact with said layer of non-thermoplastic material.

11. The method as recited in claim 9, wherein heat is conducted through said flap during step (d).

12. A method for providing a bag made of a laminated material with a closure comprising a folded web of thermoplastic material, said laminated material comprising an interior layer of thermoplastic material and a non-interior layer of non-thermoplastic material, said method comprising the following steps:

(a) slitting the bag along first and second lines so that a top marginal portion of one wall of the bag disposed between said first and second lines forms a flap;

(b) folding back said flap to uncover a topmost portion of the other wall;

(c) joining one leg of said folded web of thermoplastic material to said inner layer of thermoplastic material of at least a portion of said topmost portion of said other wall uncovered by step (b); and (d) joining said inner layer of thermoplastic material of a portion of said flap to the other leg of said web of thermoplastic material after steps (a)-(c) have been performed.

13. The method as recited in claim 12, wherein said closure further comprises a zipper joined to and covered by said folded web.

14. The method as recited in claim 12, wherein heat is conducted through both legs of said folded web and not through said flap during step (c).

15. The method as recited in claim 14, wherein the source of said heat is not in contact with said layer of non-thermoplastic material.

16. The method as recited in claim 14, wherein heat is conducted through said flap during step (d).

* * * * *